US010342313B2

(12) United States Patent
Kang

(10) Patent No.: US 10,342,313 B2
(45) Date of Patent: Jul. 9, 2019

(54) OUTLET PUMP VESSEL OF LIQUID CONTENT WHICH IS ABLE TO INTERCEPT AIR

(71) Applicant: Seong Il Kang, Seongnam-si (KR)

(72) Inventor: Seong Il Kang, Seongnam-si (KR)

( * ) Notice: Subject to any disclaimer, the term of this patent is extended or adjusted under 35 U.S.C. 154(b) by 0 days.

(21) Appl. No.: 15/778,987

(22) PCT Filed: Nov. 28, 2016

(86) PCT No.: PCT/KR2016/013757
§ 371 (c)(1),
(2) Date: May 24, 2018

(87) PCT Pub. No.: WO2017/091045
PCT Pub. Date: Jun. 1, 2017

(65) Prior Publication Data

US 2018/0344005 A1 Dec. 6, 2018

(30) Foreign Application Priority Data

Nov. 27, 2015 (KR) ..... 10-2015-0167721
Dec. 9, 2015 (KR) ..... 10-2015-0174924

(51) Int. Cl.
*B65D 47/00* (2006.01)
*B65D 83/20* (2006.01)
(Continued)

(52) U.S. Cl.
CPC ..... *A45D 34/00* (2013.01); *B65D 47/00* (2013.01); *B65D 83/00* (2013.01); *B65D 83/205* (2013.01);
(Continued)

(58) Field of Classification Search
CPC ..... A45D 34/00; A45D 2200/051; A45D 2200/055; B65D 47/00; B65D 83/00; B65D 83/205; B65D 83/20
(Continued)

(56) References Cited

U.S. PATENT DOCUMENTS 3,130,877 A * 4/1964 Miller ..... A45D 34/00 222/207
5,624,055 A * 4/1997 Clanet ..... B65D 83/206 222/135
(Continued)

FOREIGN PATENT DOCUMENTS

KR 20-0233932 Y1 9/2001
KR 20-0241998 Y1 9/2001
(Continued)

*Primary Examiner* — Benjamin R Shaw
(74) *Attorney, Agent, or Firm* — Novick, Kim & Lee, PLLC; Jae Youn Kim

(57) ABSTRACT

Disclosed is an outlet pump vessel of a liquid content which is able to intercept the air, including a sealing nozzle having an inlet through which the liquid content is discharged during operation of the push button and the inlet of the sealed nozzle is closed during non-operation of the push button by inserting the sealed nozzle into an outlet of the liquid content of the push button to prevent the liquid content of cosmetics remaining on a transfer passage from being oxidized or deteriorated due to contact with the air and the liquid content on a discharge port side from being solidified and hardened.

5 Claims, 7 Drawing Sheets

(51) Int. Cl.
*A45D 34/00* (2006.01)
*B65D 83/00* (2006.01)

(52) U.S. Cl.
CPC .. *A45D 2200/051* (2013.01); *A45D 2200/055* (2013.01)

(58) Field of Classification Search
USPC ..... 222/380
See application file for complete search history.

(56) References Cited

U.S. PATENT DOCUMENTS 6,264,067 B1 * 7/2001 Lasserre ..... B05B 11/3097 222/108
7,743,948 B2 * 6/2010 Drennow ..... B67D 1/0082 222/207
2005/0115990 A1 * 6/2005 Kang, III ..... B05B 11/3001 222/321.9
2006/0186139 A1 * 8/2006 Laidler ..... B05B 11/0027 222/207
2010/0012680 A1 * 1/2010 Canfield ..... A45D 34/04 222/207
2010/0147898 A1 * 6/2010 Blumenstein ..... B05B 11/0027 222/402.13
2015/0321828 A1 * 11/2015 Neuhaus ..... B05B 11/3097 222/1

FOREIGN PATENT DOCUMENTS

KR 20-0282740 Y1 7/2002
KR 10-0484052 B1 5/2005
KR 20-0384899 Y1 5/2005
KR 20-0408011 Y1 2/2006
KR 20-0408019 Y1 2/2006
KR 10-0923767 B1 10/2009
KR 10-0935909 B1 1/2010

* cited by examiner

OUTLET PUMP VESSEL OF LIQUID CONTENT WHICH IS ABLE TO INTERCEPT AIR

CROSS-REFERENCE TO RELATED APPLICATION(S)

This application claims benefit of priority to Korean Patent Application No. 10-2015-0167721 filed on Nov. 27, 2015 and Korean Patent Application No. 10-2015-0174924 filed on Dec. 9, 2015 in the Korean Intellectual Property Office, the disclosures of which are incorporated herein by reference in their entireties.

BACKGROUND

1. Field

The present invention relates to an outlet pump vessel of a liquid content which is able to intercept air, and more particularly, to an outlet pump vessel of a liquid content which is able to intercept air, which opens an inlet of a sealing nozzle through a liquid content is discharged during operation of a push button and closes the inlet of the sealing nozzle during non-operation of the push button to prevent the liquid content from being dried and solidified.

2. Description of Related Art

As disclosed in Korean Utility Model Registration No. 0408011, a discharge pump is generally mounted on a vessel and used as a means for discharging a small amount of gel-like contents contained in the vessel.

The discharge pump in the related art mounted on the vessel and discharging a small amount of gel-like contents is used for discharging the liquid contents in the vessel through a discharge nozzle by upward and downward movement of a piston and has an advantage in that the discharge pump can discharge and use an appropriate amount of liquid contents, but has a problem in that a nozzle inlet is continuously opened and air or various foreign substances flow through the discharge nozzle inlet, and as a result, the liquid contents which remain in the discharge nozzle are oxidized and deteriorated or the liquid content at the inlet is hardened.

Therefore, when the liquid contents are discharged and used through the discharge nozzle, the liquid contents that are initially discharged can not be used, and when the deteriorated liquid contents on the discharge nozzle are used without consideration, skin troubles are caused and reliability of a product is lowered.

In order to solve the above problems, a discharge pump that is designed to be able to close the discharge nozzle is contrived.

The discharge pump configured to close the discharge nozzle is disclosed in Korean Utility Model Nos. 233932, 241998, and 282740.

The pre-registered discharge pump has an opening/closing rod that can close the inlet of the discharge nozzle after discharging the liquid contents through the discharge nozzle.

In the pre-registered design in which the opening and closing is selectively performed by the opening/closing rod, the discharge nozzle is constituted by a nozzle and an opening/closing rod (insertion rod).

There are two types of discharge nozzles, for example, a discharge nozzle in which the inlet of the nozzle is closed by actuating the nozzle and a discharge nozzle in which the opening/closing rod that closes the inlet of the nozzle is actuated.

As described above, the discharge nozzle configured in such a manner that the inlet of the nozzle is closed while the nozzle or the opening/closing rod is actuated solves the above-mentioned problem. However, since a structure of the discharge nozzle is complicated, it takes a long time for assembling and production, and as a result, it is difficult to enhance productivity and production cost of the product increases due to diversification of peripheral parts for actuating the discharge nozzle.

SUMMARY

The present invention is invented to meet the needs of the related art and the has been made in an effort to provide an outlet pump vessel of a liquid content which is able to intercept air, which opens an inlet of a sealing nozzle through a liquid content is discharged during operation of a push button and closes the inlet of the sealing nozzle during non-operation of the push button to prevent the liquid content from being dried and solidified.

According to a first exemplary embodiment of the present invention, provided is an outlet pump vessel of a liquid content which is able to intercept the air, including: an outer vessel 2 containing an inner vessel 1 therein; a pump body 10 as a member of which an upper part screw-coupled to an upper opening of the outer vessel 2 having multiple steps formed on an outer circumferential surface and having a latching step 11 formed on a lower end of an inner circumferential surface thereof; a cylinder 20 positioned inside the pump body 10 and in which an outer flange 21 is supported on an upper inlet 1*a* of the inner vessel 1; and an elevating device 30 which ascends and descends from the inner circumferential surface of the cylinder 20 by a pushing operation of a push button 40, in which in the push button 40 as a cylindrical member whose upper part is closed, an inner hole 41 which is in communication with the elevating rod 33 with the upper and lower parts opened, a side hole 42 which is in communication with one side of the upper part of the inner hole 42, the sealing nozzle 43 is inserted into the side hole 42, and a "ㄱ"-shaped push member 44 is installed, which is inserted through an upper hole 43*a* of the sealing nozzle 43 to push the lower part of the sealing nozzle 43 by the pushing operation and open a slit 43*b* formed at the front.

One side of the sealing nozzle 43 is opened to be in communication with the inner hole 41 of the push button 40 and the other side protrudes to the outside of the push button 40 and has the slit 43*b* formed in a horizontal direction and an inner protrusion 43*c* which protrudes in a longitudinal direction and is pushed by the "ㄱ"-shaped push member 44 to open the slit 43*b* is formed in a inner lower part of the sealing nozzle 43, and the "ㄱ"-shaped push member 44 is constituted by a vertical tip 44*a* inserted into the sealing nozzle 43 and a horizontal push part 44*b* horizontally formed in the upper part of the vertical tip 44*a* and inserted into an upper surface groove of the push button 40.

According to a second exemplary embodiment of the present invention, in the outlet pump vessel of a liquid content which is able to intercept the air, one side of the sealing nozzle 43 is opened to be in communication with the inner hole 41 of the push button 40 and the other side protrudes to the outside of the push button 40 and has the slit 43*b* formed in a horizontal direction and an inner protrusion 43*c* which protrudes in a longitudinal direction and is pushed by the "ㄱ"-shaped push member 44 to open the slit

43*b* is formed in a inner lower part of the sealing nozzle 43, and the "ㄱ"-shaped push member 44 is constituted by a "ㄱ"-shaped vertical tip 44*c* inserted into the sealing nozzle 43 and a horizontal push part 44*d* horizontally formed on the upper end of the "ㄱ"-shaped vertical tip 44*c* and inserted into the upper surface groove of the push button 40.

According to a second exemplary embodiment of the present invention, in the outlet pump vessel of a liquid content which is able to intercept the air, the push button 40 further includes a horizontal rib 45 formed in such a manner that the lower surface of the sealing nozzle 43 is inserted into the lower surface of the side hole 42.

One side of the sealing nozzle 43 is opened to be in communication with the inner hole 41 of the push button 40 and the other side protrudes to the outside of the push button 40 and has the slit 43*b* formed in a horizontal direction and an inner protrusion 43*c* which protrudes in a longitudinal direction and is pushed by the "ㄱ"-shaped push member 44 to open the slit 43*b* is formed in a inner lower part of the sealing nozzle 43, and the horizontal rib 45 is positioned above the inner protrusion 43*c* of the sealing nozzle 43 and pushed by the vertical tip 44*a* of the "ㄱ"-shaped push member 44 to open the slit 43*b* of the sealing nozzle 43.

According to the outlet pump vessel of a liquid content, which is able to intercept air, the inlet of the sealing nozzle through which the liquid content is discharged during operation of the push button and the inlet of the sealing nozzle is closed during non-operation of the push button by inserting the sealing nozzle into an outlet of the liquid content of the push button to prevent the liquid content of cosmetics remaining on a transfer passage from being oxidized or deteriorated due to contact with the air and the liquid content on a discharge port side from being solidified and hardened.

DETAILED DESCRIPTION OF THE EXEMPLARY EMBODIMENTS

Figure 1:
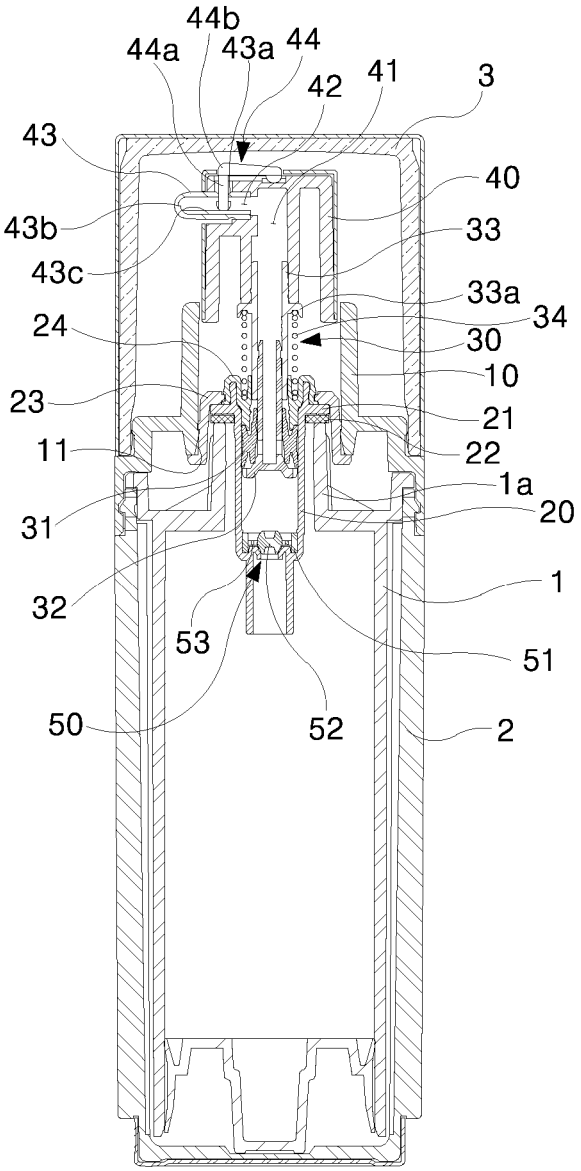
FIG. 1 is a longitudinal cross-sectional view illustrating an outlet pump vessel of a liquid content which is able to intercept the air according to a first second exemplary embodiment of the present invention.
Figure 2A:
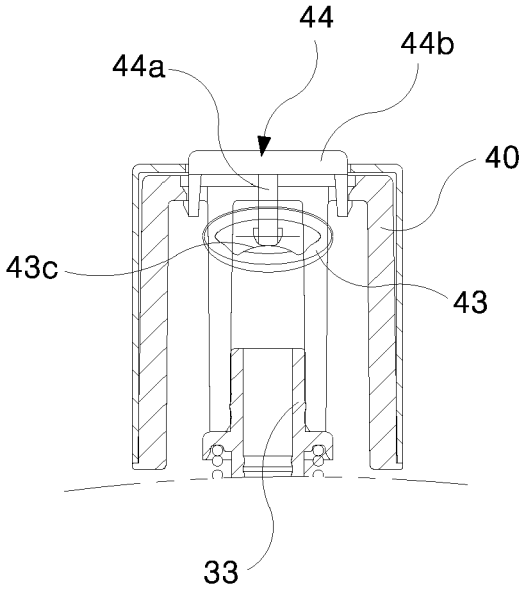
FIG. 2A is a side cross-sectional view illustrating a discharge nozzle of the outlet pump vessel of a liquid content according to the first second exemplary embodiment of the present invention before operation.
Figure 2B:
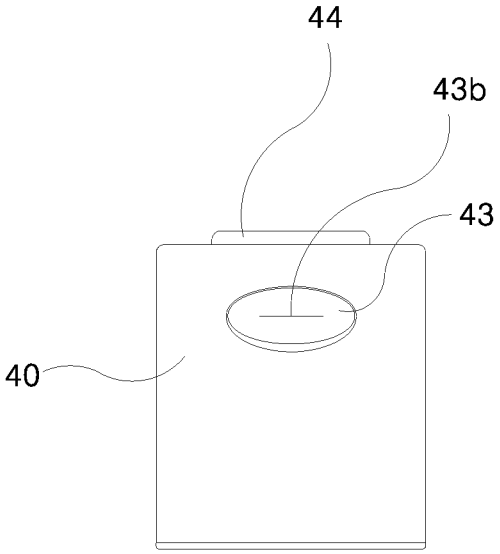
FIG. 2B is an external cross-sectional view illustrating the discharge nozzle of the outlet pump vessel of a liquid content according to the first second exemplary embodiment of the present invention before the operation.
Figure 2C:
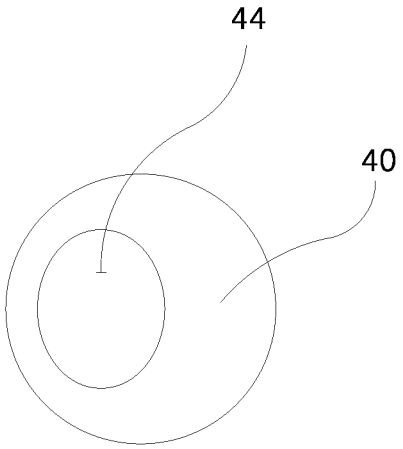
FIG. 2C is a plan view illustrating the discharge nozzle of the outlet pump vessel of a liquid content according to the first second exemplary embodiment of the present invention.

Hereinafter, a preferable embodiment of the present invention will be described in detail with reference to the accompanying drawings. Moreover, in describing the present invention, a detailed description of related known configurations or functions may be omitted to avoid obscuring the subject matter of the present invention.

Exemplary Embodiments

As illustrated in FIGS. 1 to 3B, an outlet pump vessel of a liquid content which is able to intercept the air according to a first exemplary embodiment of the present invention includes an outer vessel 2 containing an inner vessel 1 therein, a pump body 10 as a member of which an upper part screw-coupled to an upper opening of the outer vessel 2 having multiple steps formed on an outer circumferential surface, a cylinder 20 positioned inside the pump body 10 and in which an outer flange 21 is supported on an upper inlet 1*a* of the inner vessel 1, and an elevating device 30 which ascends and descends from the inner circumferential surface of the cylinder 20 by a pushing operation of a push button 40.

A locking step 11 is formed on a lower end of the inner circumferential surface of the cylindrical pump body 10.

An annular packing 22 is inserted into, a cylindrical outer fixing member 23 of which an outer surface is locked to the locking step 11 formed on the inner circumference surface of the pump body 10 to fix the cylinder 20 while pushing an upper surface of the outer flange 21 is installed on, and an inner fixing member 24 which is formed in a cylindrical shape to fix the cylinder 20 while enclosing the upper circumference surface of the outer fixing member 23 and the upper inner circumference surface of the cylinder 20 is installed on a lower surface of the outer flange 21 of the cylinder 20 fastened to the pump body 10 so as to come into close contact with the upper inlet 1*a* of the inner vessel 1.

The elevating device 30 includes a cylindrical sealing piston 31 that is in close contact with the inner circumferential surface of the cylinder 20, an operation cylinder rod 32 coupled to the inner circumferential surface of the sealing piston 31, an elevating rod 33 of which the lower end is coupled to an upper outer circumference surface of the operation cylinder rod 32 and the upper end is coupled to the push button 40, and a cylinder spring 34 installed between the lower end of an outer flange 33*a* of the elevating rod 33 and the upper surface of the inner fixing member 24 and compressed and expanded according to the pushing operation of the push button 40.

In the push button 40 as a cylindrical member whose upper part is closed, an inner hole 41 which is in communication with the elevating rod 33 with the upper and lower parts opened, a side hole 42 which is in communication with one side of the upper part of the inner hole 42, the sealing nozzle 43 is inserted into the side hole 42, and a "ㄱ"-shaped push member 44 is installed, which is inserted through an upper hole 43*a* of the sealing nozzle 43 to push the lower part of the sealing nozzle 43 by the pushing operation and open a slit 43*b* formed at the front.

One side of the sealing nozzle 43 is opened to be in communication with the inner hole 41 of the push button 40 and the other side protrudes to the outside of the push button 40 and has the slit 43*b* formed in a horizontal direction and an inner protrusion 43*c* which protrudes in a longitudinal direction and is pushed by the "ㄱ"-shaped push member 44 to open the slit 43*b* is formed in a inner lower part of the sealing nozzle 43.

When the sealing nozzle 43 as a flexible member is pushed by the "ㄱ"-shaped push member 44, the slit 43*b* is widened and opened, but when pushing force is released, the slit 43*b* is sealed.

The "ㄱ"-shaped push member 44 is constituted by a vertical tip 44*a* inserted into the sealing nozzle 43 and a horizontal push part 44*b* horizontally formed in the upper part of the vertical tip 44*a* and inserted into an upper surface groove of the push button 40.

A check valve 50 is inserted into the lower end of the cylinder 20. In the check valve 50 having a disk shape, a rim 51 is formed, which is in close contact with the inner circumferential surface of the cylinder 20, an opening/closing ball 52 that selectively opens/closes a liquid content inflow hole is formed at the center of the rim 51 via a flow plate 53 and multiple liquid content passages are formed, which enables the liquid contents which flow through the liquid content inflow hole of the cylinder 20 to flow into the upper part in the cylinder 20.

Figure 4:
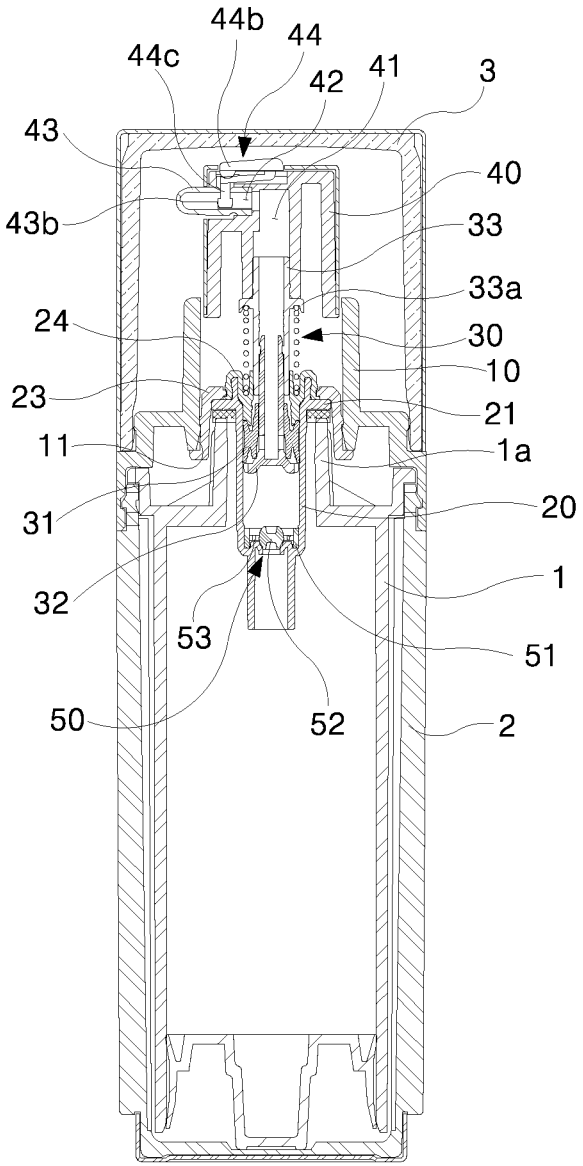
FIG. 4 is a longitudinal cross-sectional view illustrating an outlet pump vessel of a liquid content which is able to intercept the air according to a second exemplary embodiment of the present invention.

FIG. 4 is a longitudinal cross-sectional view illustrating an outlet pump vessel of a liquid content which is able to intercept the air according to a second exemplary embodiment of the present invention and in the second exemplary embodiment of the present invention, only "ㄱ"-shaped push member 44 according to the first exemplary embodiment is a different part. That is, the "ㄱ"-shaped push member 44 is constituted by a "ㄱ"-shaped vertical tip 44*c* inserted into the sealing nozzle 43 and a horizontal push part 44*d* horizontally formed on the upper end of the "ㄱ"-shaped vertical tip 44*c* and inserted into the upper surface groove of the push button 40.

Figure 5:
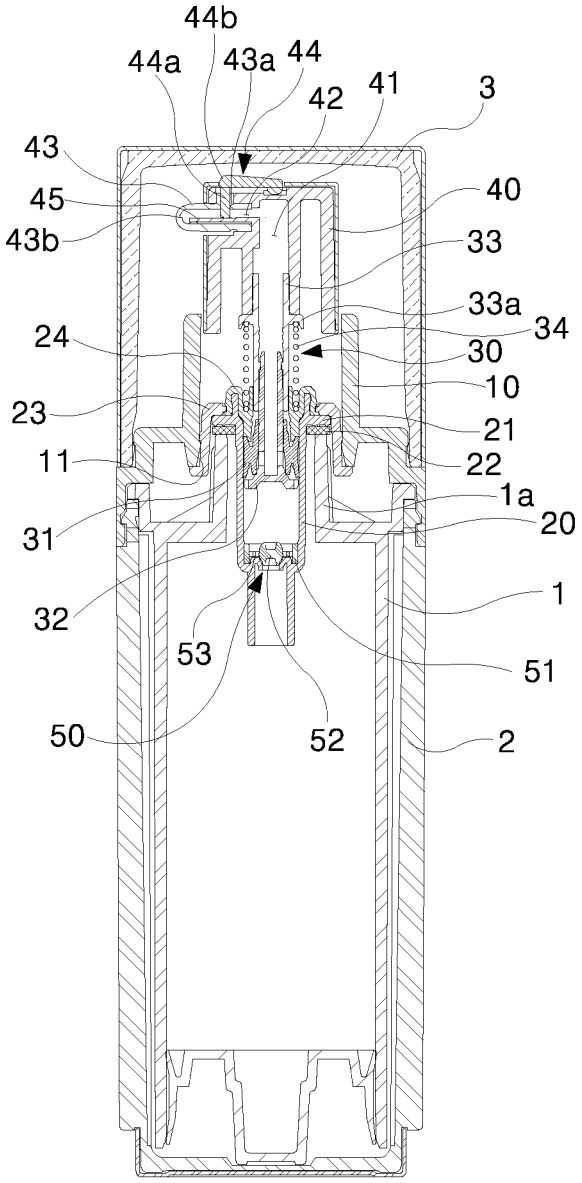
FIG. 5 is a longitudinal cross-sectional view illustrating an outlet pump vessel of a liquid content which is able to intercept the air according to a third exemplary embodiment of the present invention.
Figure 6:
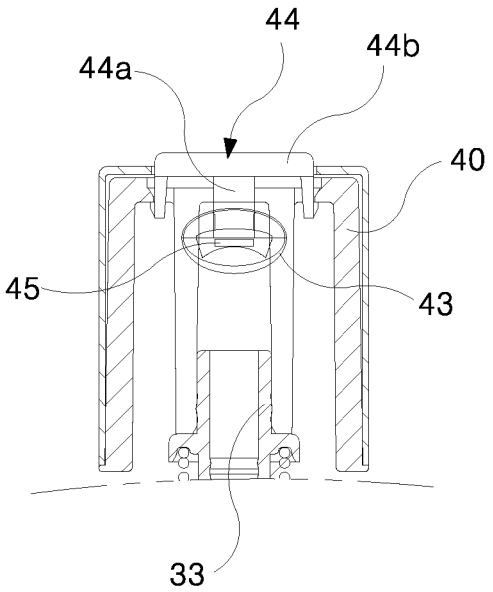
FIG. 6 is a side cross-sectional view illustrating the discharge nozzle of the outlet pump vessel of a liquid content according to the third second exemplary embodiment of the present invention before the operation.

FIG. 5 is a longitudinal cross-sectional view illustrating an outlet pump vessel of a liquid content which is able to intercept the air according to a third exemplary embodiment of the present invention and FIG. 6 is a side cross-sectional view illustrating the discharge nozzle of the outlet pump vessel of a liquid content according to the third second exemplary embodiment of the present invention before the operation.

As illustrated in FIGS. 5 and 6, the third exemplary embodiment is the same as the first and second exemplary embodiments and is different from the first and second exemplary embodiments only in an internal structure. That is, in the push button 40 as a cylindrical member whose upper part is closed, an inner hole 41 which is in communication with the elevating rod 33 with the upper and lower parts opened, a side hole 42 which is in communication with one side of the upper part of the inner hole 42, the sealed nozzle 43 is inserted into the side hole 42, a "ㄱ"-shaped push member 44 is installed, which is inserted through an upper hole 43*a* of the sealed nozzle 43 to push the lower part of the sealed nozzle 43 by the pushing operation and open a slit 43*b* formed at the front, and a horizontal rib 45 is formed so that the lower surface of the sealing nozzle 43 is inserted into the lower surface of the side hole 42.

The horizontal rib 45 is positioned above the inner protrusion 43*c* of the sealing nozzle 43 and pushed by the vertical tip 44*a* of the "ㄱ"-shaped push member 44 to open the slit 43*b* of the sealing nozzle 43.

Next, an action and an effect of the outlet pump vessel of the liquid content which is able to intercept the air configured as above will be described.

Figure 3A:
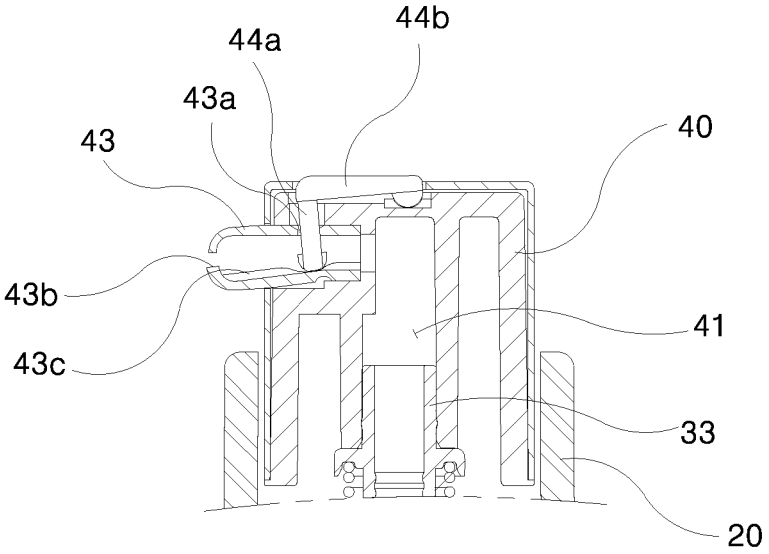
FIG. 3A is a side cross-sectional view illustrating the discharge nozzle of the outlet pump vessel according to the first second exemplary embodiment of the present invention during the operation.
Figure 3B:
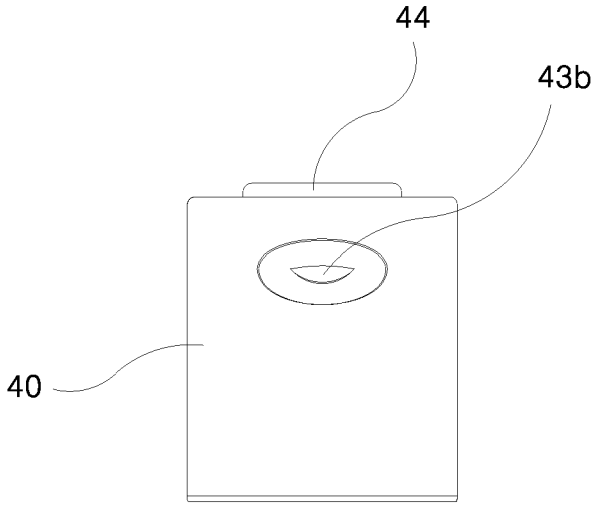
FIG. 3B is an external cross-sectional view illustrating the outlet pump vessel of a liquid content which is able to intercept the air according to the first second exemplary embodiment of the present invention before the operation.

In order to use the outlet pump vessel of the liquid content, first, when a vessel lid 3 is removed, the push button 40 is pushed, and pushed together with the "ㄱ"-shaped push member 44 which protrudes on the upper surface of the push button 40, the push button 40 descends and an actuating cylinder rod 32 descends in the cylinder 20 and while a space in the cylinder 20 is compressed, that is, reduced, the liquid content in the vessel introduced into the cylinder 20 through the check valve 50 and the introduced liquid content is sucked through the center of the actuating cylinder rod 32 and the "ㄱ"-shaped push member 44 is pushed, and as a result, the lower end in the sealing nozzle 43 is pushed and the slit 43*b* is thus opened to discharge the liquid content to the slit 43*b* (see FIG. 3B).

In addition, when pushing of the push button 40 and the "ㄱ"-shaped push member 44 is released, a cylindrical spring 34 is expanded and the push button 40 ascends and simultaneously, the vertical tip 44*a* of the "ㄱ"-shaped push member 44 ascends and the slit 43*b* is closed, that is, upper and lower sides are in contact with each other to be sealed. The upper and lower sides are sealed to prevent the liquid contents of the cosmetics which remain on the transfer passage from being oxidized and deteriorated due to contact with the air or the liquid content at the discharge port from being solidified and hardened.

As described above, detailed exemplary embodiments have been described in the detailed description of the present invention, but a possibility that the technology of the present invention will be easily modified and executed by those skilled in the art is apparent and the modified exemplary embodiments will be included in the technical spirit disclosed in the appended claims of the present invention.

What is claimed is:

1. An outlet pump vessel of a liquid content which is able to intercept the air, comprising:

an outer vessel containing an inner vessel therein;

a pump body including an upper part screw-coupled to an upper opening of the outer vessel having multiple steps formed on an outer circumferential surface and having a latching step formed on a lower end of an inner circumferential surface thereof;

a cylinder positioned inside the pump body and in which an outer flange is supported on an upper inlet of the inner vessel; and an elevating device which ascends and descends from the inner circumferential surface of the cylinder by a pushing operation of a push button, wherein in the push button as a cylindrical member whose upper part is closed, an inner hole which is in communication with an elevating rod with the upper and lower parts opened, a side hole which is in communication with one side of the upper part of the inner hole, a sealing nozzle is inserted into the side hole, and a reversed L-shaped push member is installed, which is inserted through an upper hole of the sealing nozzle to push a lower part of the sealing nozzle by the pushing operation and open a slit formed at the front.

2. The outlet pump vessel of claim 1, wherein one side of the sealing nozzle is opened to be in communication with the inner hole of the push button and the other side protrudes to the outside of the push button and has the slit formed in a horizontal direction and an inner protrusion which protrudes in a longitudinal direction and is pushed by the reversed L-shaped push member to open the slit is formed in an inner lower part of the sealing nozzle, and the reversed L-shaped push member is constituted by a vertical tip inserted into the sealing nozzle and a horizontal push part horizontally formed in the upper part of the vertical tip and inserted into an upper surface groove of the push button.

3. The outlet pump vessel of claim 1, wherein one side of the sealing nozzle is opened to be in communication with the inner hole of the push button and the other side protrudes to the outside of the push button and has the slit formed in a horizontal direction and an inner protrusion which protrudes in a longitudinal direction and is pushed by the reversed L-shaped push member to open the slit is formed in an inner lower part of the sealing nozzle, and the reversed L-shaped push member is constituted by a vertical tip inserted into the sealing nozzle and a horizontal push part horizontally formed on the upper end of the vertical tip and inserted into the upper surface groove of the push button.

4. The outlet pump vessel of claim 1, wherein the push button further includes a horizontal rib formed in such a manner that the lower surface of the sealing nozzle is inserted into the lower surface of the side hole.

5. The outlet pump vessel of claim 4, wherein one side of the sealing nozzle is opened to be in communication with the inner hole of the push button and the other side protrudes to the outside of the push button and has the slit formed in a horizontal direction and an inner protrusion which protrudes in a longitudinal direction and is pushed by the reversed L-shaped push member to open the slit is formed in an inner lower part of the sealing nozzle, and the horizontal rib is positioned above the inner protrusion of the sealing nozzle and pushed by the vertical tip of the reversed L-shaped push member to open the slit of the sealing nozzle.

* * * * *